US011987470B2

(12) United States Patent
Dronsfield

(10) Patent No.: US 11,987,470 B2
(45) Date of Patent: May 21, 2024

(54) SHEET COLLATING DEVICE

(71) Applicant: QUADIENT TECHNOLOGIES FRANCE, Bagneux (FR)

(72) Inventor: David Dronsfield, Buckhurst Hill (GB)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 0 days.

(21) Appl. No.: 17/841,309

(22) Filed: Jun. 15, 2022

(65) Prior Publication Data

US 2022/0411223 A1 Dec. 29, 2022

(30) Foreign Application Priority Data

Jun. 25, 2021 (EP) ..... 21305884

(51) Int. Cl.
*B65H 39/07* (2006.01)

(52) U.S. Cl.
CPC ..... *B65H 39/07* (2013.01); *B65H 2301/435* (2013.01); *B65H 2402/441* (2013.01); *B65H 2403/72* (2013.01); *B65H 2404/232* (2013.01); *B65H 2404/63* (2013.01); *B65H 2553/00* (2013.01); *B65H 2601/11* (2013.01)

(58) Field of Classification Search
CPC ..... B65H 31/36; B65H 39/07; B65H 5/006; B65H 29/14; B65H 31/20; B65H 45/142; B65H 29/58; B65H 39/042; B65H 31/30; B65H 31/3081
See application file for complete search history.

(56) References Cited

U.S. PATENT DOCUMENTS 5,007,657 A * 4/1991 Bogner ..... A63C 9/08542 280/626
5,889,453 A * 3/1999 Siepmann ..... H01H 50/021 335/83
6,575,457 B2 * 6/2003 Bakoledis ..... B23K 9/1087 271/223
6,978,995 B2 * 12/2005 Middelberg ..... B65H 31/3081 271/198
7,942,398 B1 * 5/2011 Marcinik ..... B43M 3/04 270/58.01

(Continued)

FOREIGN PATENT DOCUMENTS

EP 0455494 A2 11/1991
EP 0455494 A3 3/1993

(Continued)

*Primary Examiner* — Patrick H Mackey
(74) *Attorney, Agent, or Firm* — Cozen O'Connor

(57) ABSTRACT

Sheet collating device for accumulating sheets from at least one hopper, comprising: a lower transport path and an upper transport path; a switchable guide for directing the sheets from the at least one hopper to the lower or the upper transport path; left and right upper drive shafts connected to a right and a left upper drive pulleys supporting a pair of upper belts, a drive direction of the pair of upper belts being changed dependent on what transport path of the upper and lower transport paths is selected; first and second lower drive shafts connected to a right and a left lower drive pulleys supporting first and second pairs of lower belts; and a first series of right paddles mounted on the first pair of lower belts and a first series of left paddles mounted on the second pair of lower belts for registering a collated set of sheets.

15 Claims, 5 Drawing Sheets

(56) References Cited

U.S. PATENT DOCUMENTS

| | | | | |
|---|---|---|---|---|
| 7,984,900 | B2 * | 7/2011 | Terao | B65H 31/3081 270/58.11 |
| 8,172,216 | B2 * | 5/2012 | Oosterhoff | B65H 29/62 271/3.14 |
| 2011/0133389 | A1 | 6/2011 | Nemoto | |

FOREIGN PATENT DOCUMENTS

| | | | |
|---|---|---|---|
| EP | 1634836 | A2 | 3/2006 |
| EP | 1634836 | A3 | 2/2008 |
| EP | 2108607 | A2 | 10/2009 |
| EP | 2108607 | A3 | 9/2014 |
| WO | 9828215 | A1 | 7/1998 |

* cited by examiner

SHEET COLLATING DEVICE

TECHNICAL FIELD

The present invention relates to mail processing, and notably to improvements in mail production systems incorporating notably paper handling machines used for folding and inserting documents and inserts into envelopes.

BACKGROUND

Despite a noticeable decrease in printed correspondence, physical mail remains a preferred and efficient communication channel for many customer segments. Letters have undoubtedly more substance than emails and a higher propensity to capture and retain customer attention. The manufacturing of large batches of mail follows a number of steps. First, an output management system will receive data relative to a group of recipients from an enterprise application and prepare the documents intended for each individual customer. The system uses standard templates in which specific customer data are inserted, along with mailpiece identifiers and/or machine control instructions. The batch of documents can then be virtually sorted according to the Postal distribution order, or split in various parts corresponding to different geographic areas, and/or to the capabilities of the local production equipment. Once all these operations have been performed, the batch of documents is printed.

Mailpiece identifiers and machine control instructions are used to trigger the operation of mail processing equipment at various stages of the manufacturing process, and notably insertion. In the simplest operating mode, the job parameters are fixed and the same tasks are performed on all mailpieces. In a more elaborated mode, each mailpiece bears control codes that are read and interpreted by the inserter. In the most sophisticated (data driven) mode, the mailpiece bears a unique identifier that points to a database where the finishing instructions for that particular mailpiece are recorded.

As the documents are fed into the inserter, mailpiece ID's and/or control codes are read by the machine, the various pages of a document set are collated together, folded and inserted into an envelope. Depending on their thickness or size, specific inserts may be added before or after folding. Document sets exceeding a certain number of pages may be diverted to be inserted in a larger envelope. The inserter is typically a combination of modules corresponding to the successive steps of this process, each one having a variety of options. For instance, envelopes may be water-sealed just after insertion, the sealing module forming part of the inserting module. Scanners are used to read finishing instructions but also for integrity tracking purposes. An address printer, a franking machine, a stacker or a sorting system may be added to the inserter to complete the manufacturing process.

Most inserting machines use top feeders, where document sheets are extracted one by one from the top of a stack by feed and separation rollers, and transported along a paper path to a sheet collator. Top feeders are compatible with the A to Z print sequence, in which the documents are presented with the first page on top (face up). The first page, or address page (A), usually bears the recipient address and the mailpiece ID. A conventional sheet collator will accumulate sheets in the same order as these has been placed in the stack, so that the address is visible though the envelope window after insertion. However, for very large batches, the documents may be printed "on the fly" in a Z to A sequence, in which case the first page (A) is obscured by subsequent pages, and the address hidden. While the address may also be printed on the last page, this is often not possible or desirable for the customer. Bottom feeders may be used to extract the document in the reverse order, but this option is generally more costly and/or not available, and would not accommodate the A to Z print sequence.

Several solutions have been found to collate documents in the same order as these have been printed, or in the reverse order. For instance, U.S. Pat. No. 5,123,639, 5,147,092 or 5,655,761 disclose variations of the same principle of accumulating a sheet selectively over or under previously accumulated sheets. Though such devices are generally satisfactory for homogeneous materials, these may not be capable of handling inserts with dissimilar frictional characteristics (e.g. with a glossy finish). These may also encounter limits in collating large sets due to the weight of previously accumulated sheets. For instance, thin inserts may crash when fed under a relatively low number of sheets.

There is a need for a new sheet collating device allowing to overcome the limitations of the prior art.

OBJECT AND DEFINITION OF THE INVENTION

The object of the invention is to provide a new sheet collating device allowing the accumulation of sheets in the A to Z or in the Z to A print sequence, without requiring an additional bottom feeder.

A second object of the invention is to provide a device that can add inserts of varying thickness and materials to the document set.

Another object of the invention is to provide a device capable of handling large document sets of typically 25 sheets, or more. The maximum quantity shall be not limited by the principle of collation but rather by geometry design or other modules (e.g. folding or inserting).

The objects of the invention are achieved by a new sheet collating device for accumulating sheets from at least one hopper, comprising: a lower transport path and an upper transport path; a switchable guide for directing the sheets from the at least one hopper to the lower or the upper transport path; left and right upper drive shafts connected to a right and a left upper drive pulleys supporting a pair of upper belts, a drive direction of the pair of upper belts being changed dependent on what transport path of the upper and lower transport paths is selected; first and second lower drive shaft connected to a right and a left lower drive pulleys supporting first and second pairs of lower belts; a first and a second series of series of right paddles mounted on the first pair of lower belts and a first and a second series of left paddles mounted on the second pair of lower belts for registering a collated set of sheets.

The new collating device can further comprise a second series of right paddles symmetrically mounted on the first pair of lower belts and a second series of left paddles symmetrically mounted on the second pair of lower belts.

Advantageously, the pair of upper belts may be merged as one single belt or partitioned in more than two upper belts and one of the first and second pairs of lower belts may be merged as one single central belt, also acting as a collate bed for supporting the sheets during collation.

Preferably, for changing the drive direction of the pair of upper drive belts, the left upper drive shaft comprises a one-way clutch for driving the left upper drive pulley in a counter clockwise direction, while the right upper drive shaft comprises a one-way clutch for driving the right upper drive pulley in a clockwise direction.

Advantageously, the first lower drive shaft is configured to drive the first pair of lower belts in counter clockwise direction, causing the first series of right paddles to push the collated set of sheets towards an exit area and wherein the second lower drive shaft is configured to drive the second pair of lower belts in clockwise direction, causing the first series of left paddles to push the collated set towards a divert area.

Preferably, a main drive shaft which can be driven in either clockwise or counter clockwise direction is connected to the left upper drive shaft through a left drive belt, and to the right upper drive shaft through a right drive belt.

Advantageously, wherein the first and second lower drive shafts are configured to be driven simultaneously for keeping a curvilinear distance between the left and right paddles unchanged.

Preferably, the upper transport path is defined by a cover plate crossed by a succession of free wheels in contact with the pair of upper belts and a support plate supporting the sheets during transport in the upper transport path.

Advantageously, the cover plate is mounted on a pivot allowing access to the upper transport path in case of jam.

Preferably, an upper transport assembly comprising at least the support plate, the pair of upper belts, the upper drive pulleys and the upper drive shafts is mounted on another pivot allowing access to the collation area.

A sheet collating device further comprising a collate bed having a convex shape facing upwards for supporting the sheets during collation and keeping the sheets in touch with the pair of upper belts, and a restrictor wheel mounted on a free arm and resting over the collate bed for damping a rebound of the sheets when hitting the paddles.

The invention also relates to a folder inserter comprising a sheet collating device as cited previously.

BRIEF DESCRIPTION OF THE DRAWINGS

The invention will be described and explained with additional specificity and detail through the use of the accompanying drawings in which.

DETAILED DESCRIPTION OF EXEMPLARY EMBODIMENTS

In the following, the terms "document set(s)", "document page(s)" or "document sheet(s)" refer to the elements forming the main (principal) document set, typically a letter of one or more sheets, while the terms "insert(s)" refer to additional and/or optional elements to be added to the main document set and inserted in the same envelope to form a complete mailpiece. The inserts can be single sheets of various size, thickness and frictional characteristics, or a complementary document set, which may be bigger than the main document set itself.

The term "job" refer to a particular set of parameters which is selected for processing a batch of mailpieces. Within a job, finishing instructions may vary from one mailpiece to another, but most finishing instructions (e.g. fold type or envelope size) are common to all mailpieces.

The documents sheets are usually printed on both sides. The address is printed at a position corresponding to the letter 'A' on the first page, or address page (A). Depending on the job configuration, the document sheets may be placed face up (with the address facing upwards) or face down (with the address facing downwards) in the feeder, also called hopper.

Figure 1:
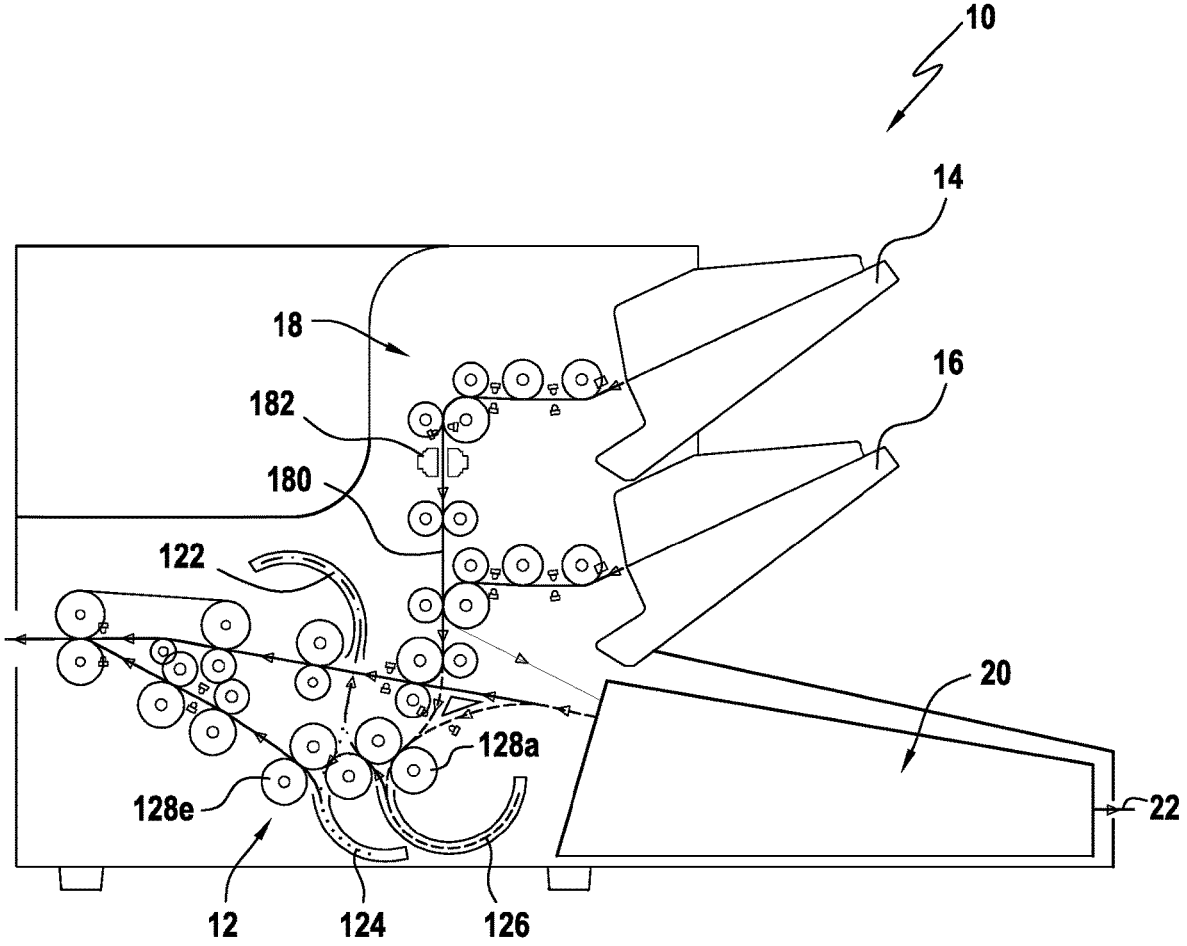
FIG. 1 is a schematic view of an inserter including the new sheet collating device.

FIG. 1 is a schematic view of an inserter including the new sheet collating device.

The inserter 10 comprises a folding unit 12, two hoppers 14, 16 for feeding sheets seriatim, and the new sheet collating device 20.

Depending on the job configuration, stacks of documents and inserts are placed in the hoppers disposed along a vertical feed tower 18. The documents are preferably placed in the first hopper 14, and additional and/or optional inserts in the second hopper 16. Other combinations are of course possible. For instance, when processing large batches of mailpieces, the inserter may comprise more than two hoppers, from which more than one may be used for the documents, and the feeding switched from one hopper to another when the first one is empty. In this manner, an operator may reload documents from the same print batch on the inserter without the job being interrupted.

The documents sheets are extracted one by one from the top of the stack and transported downstream in the feed tower along a paper path 180. In the case of a single sheet letter, the document may go directly to the folding unit 12. Otherwise the sheets will be directed to an accumulator (or collator) 20. A contact image sensor or CIS reader 182 is disposed at the middle of the feed tower 18 to scan mailpiece identifiers and/or finishing instructions as the documents are extracted from the hopper 14. Depending on the job configuration, the CIS reader may also be disposed at other locations in the feed tower and on either side of the paper path, so as to scan documents placed face down in the hopper instead of face up.

Once all the sheets of a document have been accumulated together in the collator 20, additional and/or optional inserts are added to the document set. The complete set is then directed to the folding unit 12 to be folded by a combination of fold plates 122, 124, 126, and folding rollers 128 *a* to 128*e*, and finally out of the folding unit 12 (to the left) to an inserting unit (not shown) for inserting into an envelope to form a complete mailpiece. The fold plates allow for a variety of folds depending on the desired fold type (Z, C, or V), the orientation of the documents (face up or face down) and the location of the address (top, middle or bottom). Alternatively, if folding is not required, the complete set may bypass the folding unit and go directly to the inserting unit 12 (to the left), or be diverted from the collator 20 to the divert area 22 (to the right) to be inserted by hand, or put away if any malfunction occurred.

Figure 2:
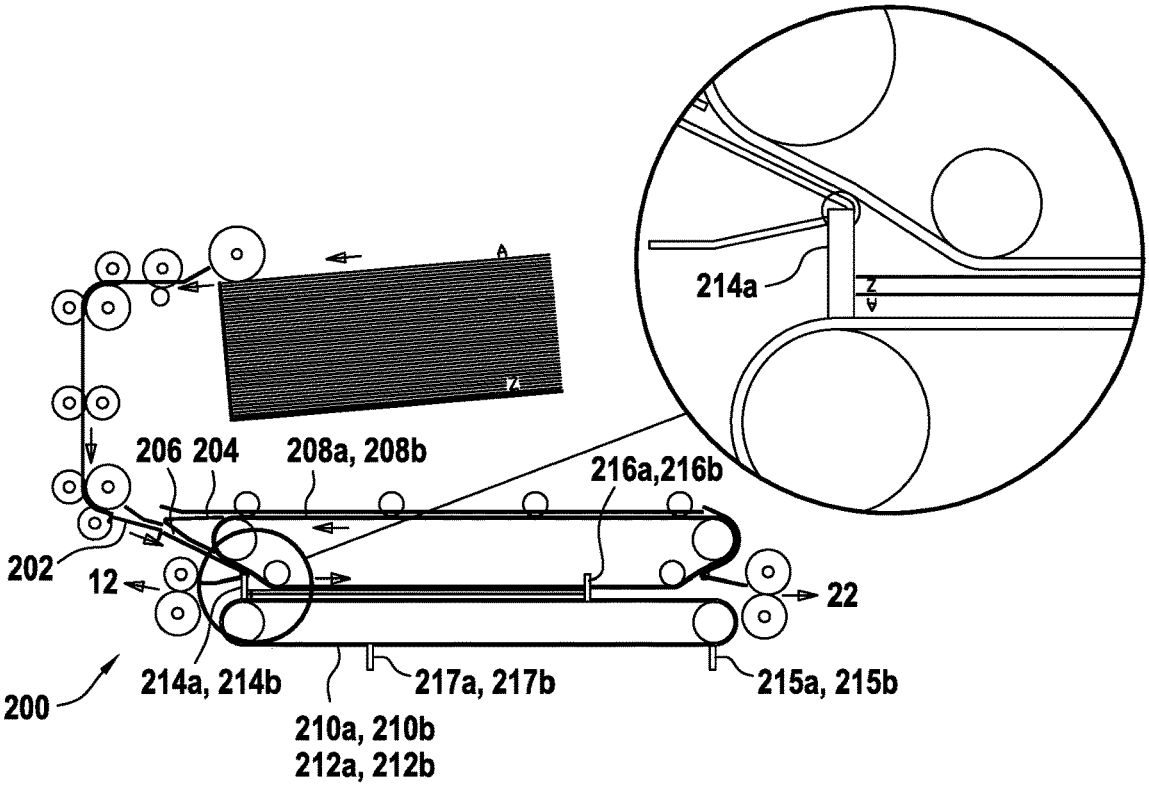
FIG. 2 is a view of the new sheet collating device accumulating sheets that have been printed in the A to Z sequence.

FIG. 2 is a view of the new sheet collating device accumulating sheets that have been printed in the A to Z sequence.

The new sheet collating device 200 has two separate paper transport paths to the collation area. A switchable guide 202 directs the sheets onto an upper path 204 or a lower path 206 depending on the print sequence. The new sheet collating device includes a pair of upper belts 208*a*, 208*b* and the drive direction of the upper belts is changed dependent on what paper transport path is selected. The new sheet collating device includes two pairs of lower belts 210*a*, 210*b*; 212*a*, 212*b*, which can be adjusted and moved independently. Two series of paddles are mounted on each pair of lower belts. In the following, we will distinguish first and second series of left paddles 214*a*, 214*b* and 215*a*, 215*b* symmetrically mounted on the first pair of lower belts 210*a*, 210*b* from first and second series of right paddles 216*a*, 216*b* and 217*a*, 217*b* symmetrically mounted on the second pair of lower belts 212*a*, 212*b* (see also FIG. 5). The terms "left" and "right" are used in the present description in reference to the registration of the sheets on the collation area as illustrated on this figure. The position of the paddles is adjusted according to the form length and the print sequence of the documents placed in the hopper.

The document sheets are placed face up in the hopper in the A to Z print sequence. The switchable guide 202 directs the sheets to the lower path 206. The upper belts 208*a*, 208*b* are driven counter clockwise and the sheets are accumulated face down in the same A to Z sequence, as can be seen in the enlarged view. The position of the first series of right paddles 216*a*, 216*b* is adjusted according to the form length, to ensure that the sheets registered against this first series of right paddles 216*a*, 216*b* are always accumulated on top of each other in the collation area. The first series of left paddles 214*a*, 214*b* are positioned slightly setback from the entry of the collation area (see enlarged view). The collated sheets are held between the left and right paddles. Additional and/or optional inserts can be added to the back of the document set in the same manner. Once the whole set is completed, the lower belts 210*a*, 210*b*; 212*a*, 212*b* can be rotated counter clockwise to transport the set towards the folding unit 12, or clockwise to transport it towards the divert area 22.

There is sufficient space between the upper and lower belts to accumulate a document set of 25 sheets or more. In a preferred embodiment, the drive to the upper belts is designed so that the slack side of the belt is over the collation area when running in either direction. In this manner, the bottom part of the belts is always in touch with the upper or last sheet being accumulated, so as to ensure a constant drive towards the first series of right paddles 216*a*, 216*b*. Indeed, as the collation area is horizontal, no help can be expected from gravity. This also ensures that any desired quantity of sheets can be collated without jamming. The material of the upper belts is chosen in order to generate enough friction for driving the sheets, but not enough for risking any damage once these have abutted against the right paddles.

Figure 3:
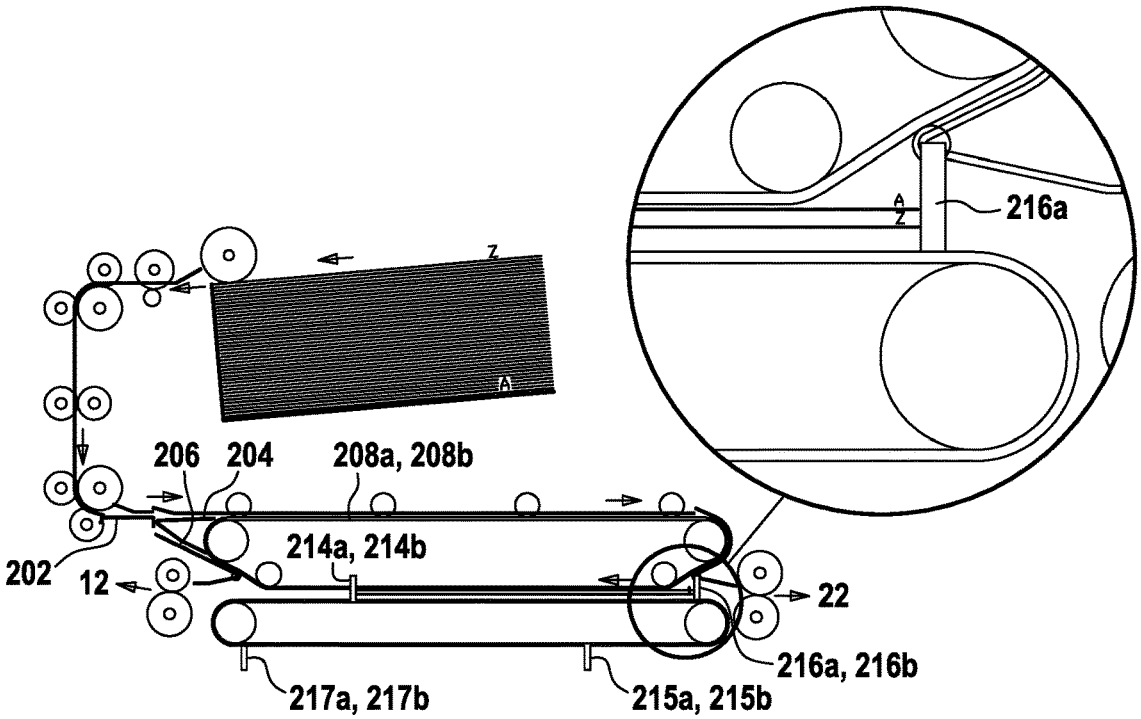
FIG. 3 is a view of the new sheet collating device accumulating sheets that have been printed in the Z to A sequence.

FIG. 3 is a view of the new sheet collating device accumulating sheets that have been printed in the Z to A sequence.

The document sheets are placed face up in the hopper. The switchable guide 202 directs the sheets to the upper path 204. The upper belts 208*a*, 208*b* are driven clockwise, so as to guide the sheets into the collation area from the right.

Contrarily to FIG. 2, the sheets are accumulated face up in the A to Z sequence, as can be seen in the enlarged view. The order of the sheets has been reversed, with the first page (A) on top as it is on the last sheet to be extracted, and the address facing upwards.

The position of the first series of left paddles 214*a*, 214*b* is adjusted according to the form length, to ensure that the sheets registered against this first series of left paddles 214*a*, 214*b* are always accumulated on top of each other. The first series of right paddles 216*a*, 216*b* are positioned slightly setback from the entry of the collation area (see enlarged view). The collated sheets are held between the left and right paddles. Once the set is completed, the lower belts 210*a*, 210*b*; 212*a*, 212*b* can be rotated counter clockwise to transport the set towards the folding unit 12, or clockwise to transport it towards the divert area 22. The upper belts 208*a*, 208*b* can be used to assist ejection or to provide resistance to ensure that the document set does not decollate (upper belts can be driven in either direction or held stationary).

Again, the slack side of the belt is over the collation area, so as to ensure a constant drive towards the first series of left paddles 214*a*, 214*b*. The material of the upper belts generates enough friction for driving the sheets, but not enough for risking any damage once these have abutted against the left paddles.

A problem arising with this situation is that any insert added on top of the main document set will obscure the first page. For jobs requiring additional and/or optional inserts, document sheets printed in the Z to A sequence can be placed face down in the hopper. This result in the main document being collated face down, with the first page at the bottom and the address facing downwards. Inserts can be added to the back of the document set without obscuring the first page. Other solutions, like extracting inserts before the main document, are possible.

Figure 4:
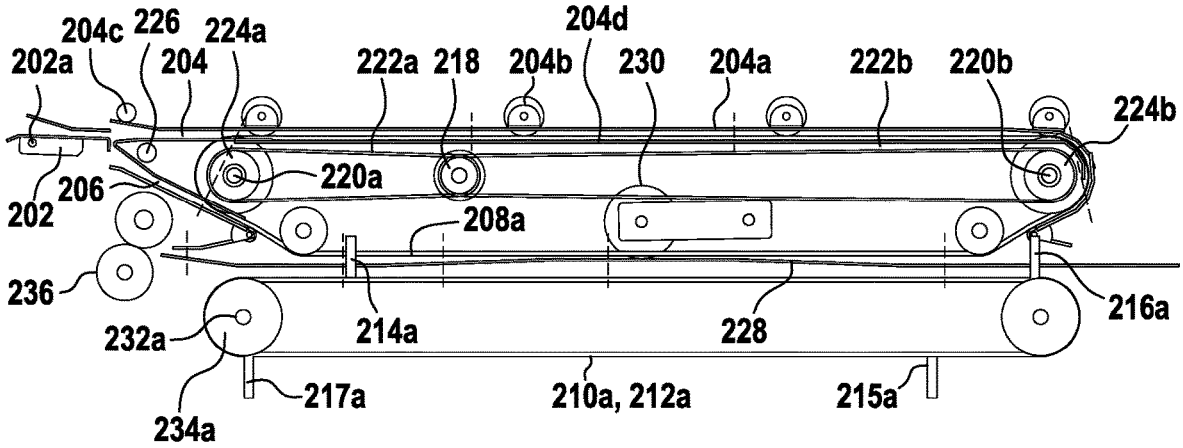
FIG. 4 is a sectional view showing additional details of the new sheet collating device.

FIG. 4 is a sectional view showing additional details of the new sheet collating device.

It shall be understood that belts, pulleys, paddles and other components that will be described hereafter do not extend transversally across the whole device and may be entwined (see also FIG. 5 for further details).

The switchable guide 202 is mounted on a pivot 202*a* in order to direct the sheets to the lower 206 or upper 204 transport path. A cover plate 204*a* protects the sheets during transport in the upper transport path 204 and includes a succession of free wheels 204*b* in contact with the upper belts 208*a*, 208*b*. The cover plate 204*a* is mounted on a pivot 204*c* allowing access to the upper transport path 204. A support plate 204*d* supports the sheets during transport in the upper transport path 204.

Figure 8:
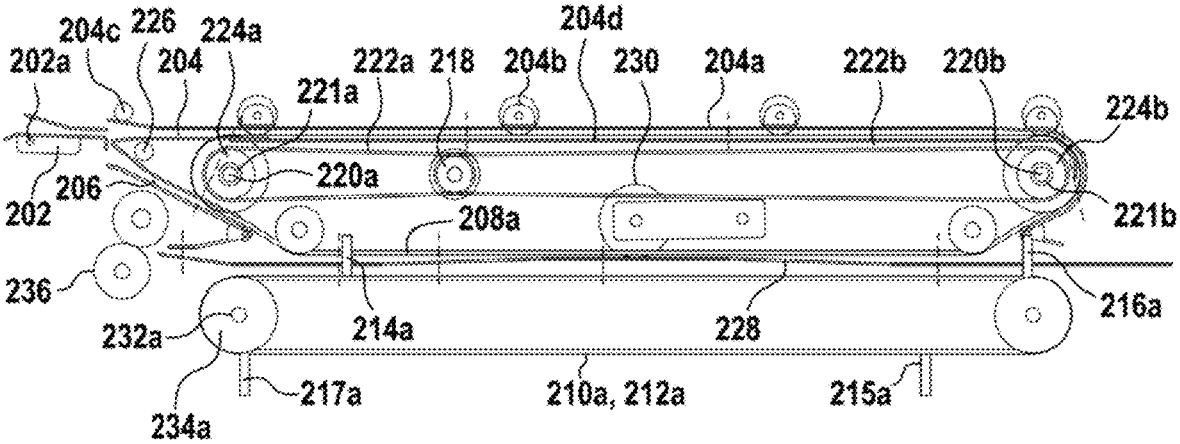
FIG. 8 is a sectional view showing additional details of the new sheet collating device, similar to that of FIG. 4 but illustrating a pair of one-way clutches.

A main drive shaft 218 is connected to an upper transport motor (not shown) which can be driven in either clockwise or counter clockwise direction. The main drive shaft 218 is connected to a left upper drive shaft 220*a* through a left drive belt 222*a*, and to a right upper drive shaft 220*b* through a right drive belt 222*b*. The left and right upper drive shafts 220*a*, 220*b* are in turn connected to left and right drive pulleys 224*a*, 224*b* supporting the pair of upper belts 208*a*, 208*b*. The drive pulleys are fitted with one-way clutches 221*a*, 221*b* (FIG. 8). The left upper drive shaft 220*a* can only drive the left drive pulley 224*a* in the counter clockwise direction, while the right upper drive shaft 220*b* can only drive the right drive pulley 224*b* in the clockwise direction. This ensures that the bottom part of the pair of upper belts 208*a*, 208*b* is always the slack side.

The pair of upper belts 208*a*, 208*b*, and their drive elements (drive shafts, drive belts and drive pulleys), the support plate 204*d* and a frame (not shown) form an upper transport assembly, which is mounted on another pivot 226 allowing access to the collation area.

A collate bed 228 extends across the collation area to support the sheets during collation. The collate bed 228 has a convex shape facing upwards, in order to keep the sheets in touch with the pair of upper belts 208*a*, 208*b* and assist paper drive in either direction. A restrictor wheel 230 mounted on a free arm rests over the collate bed 228 approximately in the middle of the collation area. The restrictor wheel 230 dampens the bounce back of the sheets when hitting the paddles.

The two series of left paddles 214*a*, 214*b*, 215*a*, 215*b* are mounted symmetrically on the lower belt 210*a*, 210*b*, while the two series of right paddles 216*a*, 216*b*, 217*a*, 217*b* are mounted symmetrically on the lower belt 212*a*, 212*b* (only the left paddles 214*a*, 215*a*, the right paddles 216*a*, 217*a*, and the lower belts 210*a*, 212*a* are represented on this sectional view). The lower belts 210*a*, 210*b* can be driven independently from the lower belts 212*a*, 212*b* so that the left paddles 214*a*, 214*b*, 215*a*, 215*b* can be moved and positioned independently from the right paddles 216*a*, 216*b*, 217*a*, 217*b*.

A left lower drive shaft 232*a* connected to a first lower transport motor (not shown) and left drive pulleys 234*a* drive the first pair of lower belts 210*a*, 210*b* in clockwise direction, causing the first series of left paddles 214*a*, 214*b* to push the collated set towards the divert area 22. A right drive shaft 232*b* (visible in FIG. 5) connected to a second lower transport motor (not shown) and right drive pulleys 234*b* (visible on FIG. 5) drives the second pair of lower belts 212*a*, 212*b* in counter clockwise direction, causing the first series of right paddles 216*a*, 216*b* to push the collated set towards the exit wheels 236 and then to the folding unit 12. During these cycles, the left and right lower drive shafts 232*a*, 232*b* are driven simultaneously to keep the curvilinear distance between the left and right paddles unchanged. Then the second series of left paddles 215*a*, 215*b* are positioned at locations formerly occupied by the first series of left paddles 214*a*, 214*b* and the second series of right paddles 217*a*, 217*b* are positioned at locations formerly occupied by the first series of right paddles 216*a*, 216*b* for the collation of the next document set.

The operation described above may be achieved with only one series of left paddles 214*a*, 214*b* and one series of right paddles 216*a*, 216*b*. However, the second series of left paddles 215*a*, 215*b* and the second series of right paddles 217*a*, 217*b* symmetrically mounted on the lower belts 210*a*, 210*b* and 212*a*, 212*b* allows faster cycles of the new sheet collating device as it is not necessary for the lower belts to make a complete rotation for the collation of the next document set. In this manner, the throughput of the inserter can be increased.

Figure 5:
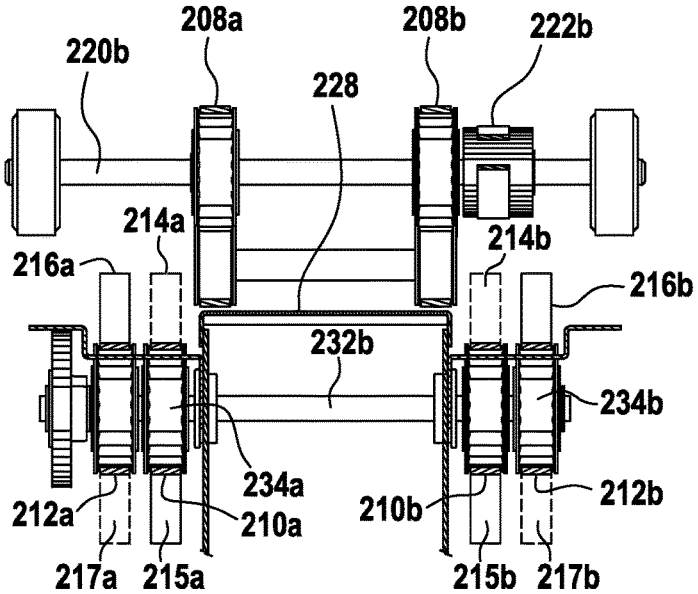
FIG. 5 is a transversal view showing further details of the new sheet collating device.

FIG. 5 is a transversal view showing further details of the new sheet collating device.

In this exemplary embodiment, there is one pair of upper belts 208*a*, 208*b*. For convenience, only the right upper drive shaft 220*b* and the right drive belt 222*b* have been represented. The collate bed 228 is located between the upper belts 208*a*, 208*b* in the middle of the collating area to support the sheets during collation.

The two pairs of lower belts 210*a*, 210*b*; 212*a*, 212*b* are disposed symmetrically on both sides of the collate bed 228. The first pair of lower belts 210*a*, 210*b* carries the first and second series of right paddles 214*a*, 214*b* and 215*a*, 215*b*, while the second pair of lower belts 212*a*, 212*b* carries the first and second series of left paddles 216*a*, 216*b* and 217*a*, 217*b*. The paddles 214*a*, 214*b*, 217*a*, 217*b* are represented in dotted lines.

The new sheet collating device also includes a plurality of sensors at different locations in the device (see for example the dotted lines in FIG. 4) whose description is not necessary to understand its operation. The term "paddles" has been used to refer the paper backstop position, but other terms such as "pawls", or "pushers" may be used instead.

Figure 6:
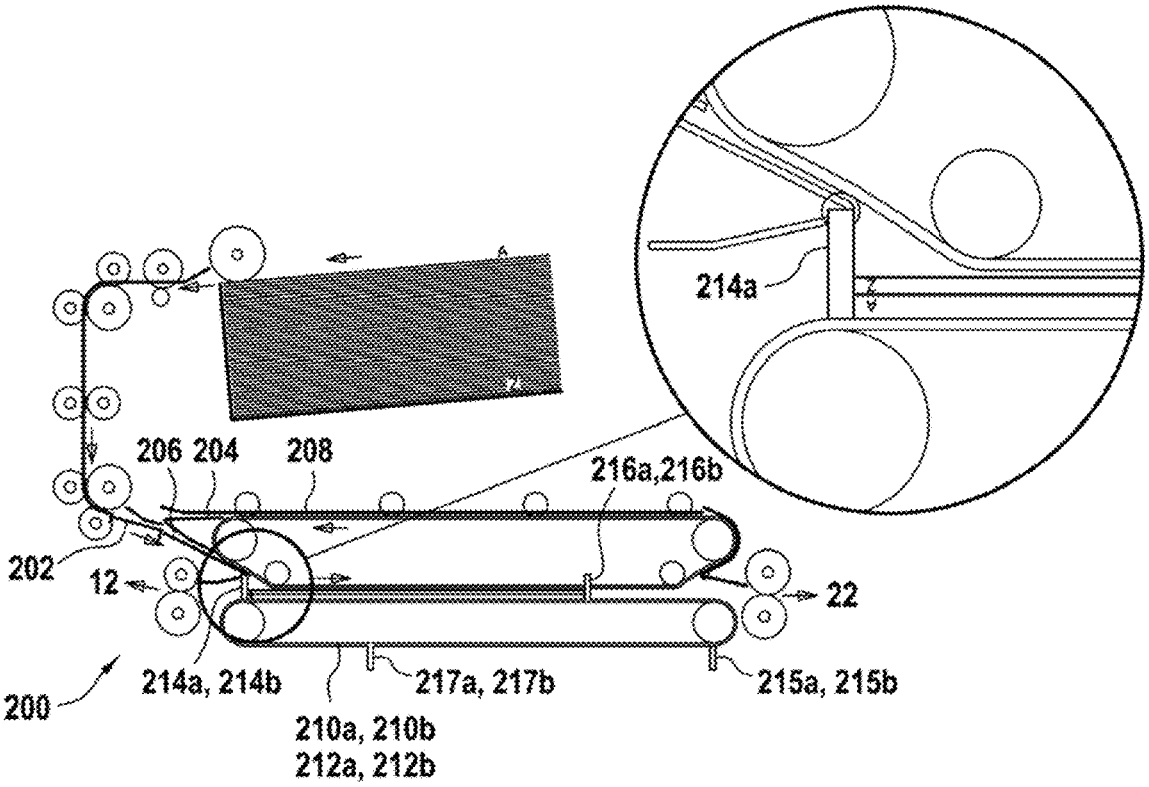
FIG. 6 is a view of the new sheet collating device accumulating sheets that have been printed in the A to Z sequence, similar to that of FIG. 2 but illustrating that the belts are merged as one single belt.

FIG. 6 is a view of the new sheet collating device accumulating sheets that have been printed in the A to Z sequence, similar to that of FIG. 2 but illustrating that the belts are merged as one single belt 208.

Figure 7:
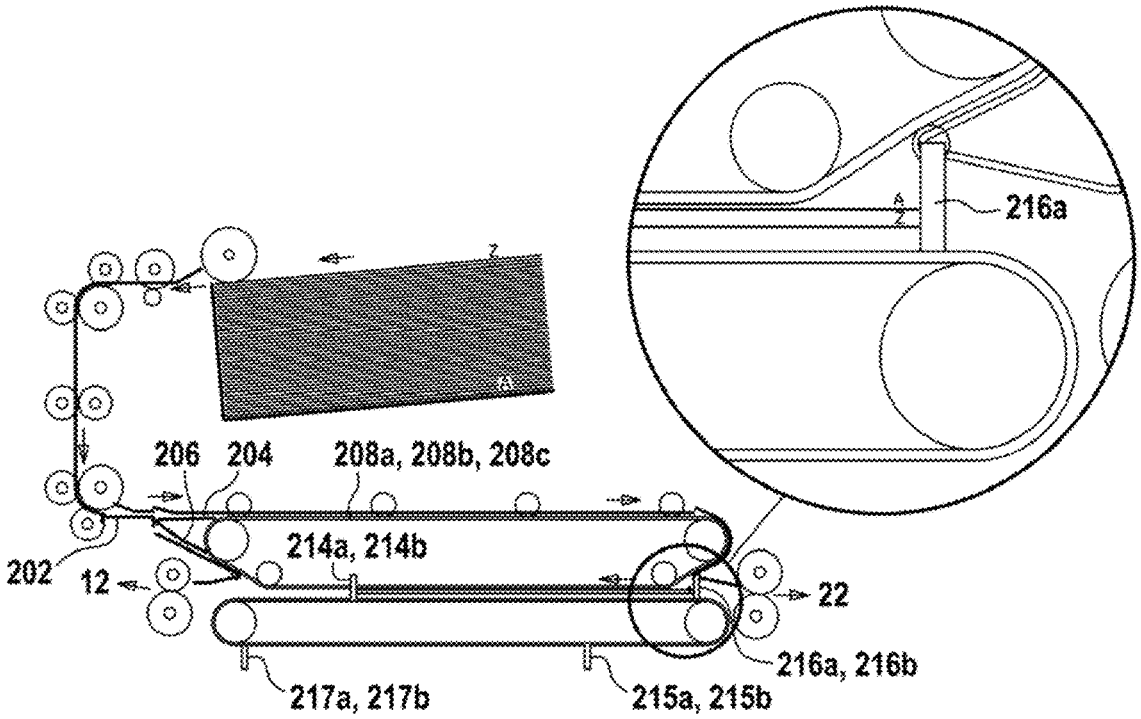
FIG. 7 is a view of the new sheet collating device accumulating sheets that have been printed in the Z to A sequence, similar to that of FIG. 2 but illustrating three upper belts.

FIG. 7 is a view of the new sheet collating device accumulating sheets that have been printed in the Z to A sequence, similar to that of FIG. 2 but illustrating three upper belts 208*a*, 208*b*, 208*c*.

FIG. 8 is a sectional view showing additional details of the new sheet collating device, similar to that of FIG. 4 but illustrating a pair of one-way clutches 221*a*, 221*b*.

Adaptations and variations can be considered. For instance only one single belt, or more than two, upper belts may be used. The position of the lower belts 210*a*, 210*b* and 212*a*, 212*b* may be inverted. The lower belts 210*a*, 210*b* (or alternatively 212*a*, 212*b*) may be merged as one single central belt, also acting as the collate bed for supporting the sheets during collation. The systems can execute machine control instructions can be in the form of software or firmware and are executable by one or more processors (e.g., microprocessors, microcontrollers, digital signal processors, FPGA, ASIC) along with storage media (e.g., magnetic hard drives, solid state drives, optical disk drives, FLASH memory, read only memory, random access memory), coupled by one or more buses, for example as a computer system that is configured for the particular purpose described herein. The above description is only illustrative of a preferred embodiment and not intended to limit the scope of the invention, which is reflected in the appended claims.

The invention claimed is:

1. A sheet collating device for accumulating sheets from at least one hopper, comprising:

a lower transport path and an upper transport path;

a switchable guide for directing the sheets from the at least one hopper to the lower or the upper transport path;

left and right upper drive shafts connected to a right and a left upper drive pulleys supporting a pair of upper belts, a drive direction of the pair of upper belts being changed dependent on what transport path of the upper and lower transport paths is selected;

first and second lower drive shaft connected to a right and a left lower drive pulleys supporting first and second pairs of lower belts; and a first series of right paddles mounted on the first pair of lower belts and a first series of left paddles mounted on the second pair of lower belts for registering a collated set of sheets.

2. The sheet collating device according to claim 1, further comprising a second series of right paddles symmetrically mounted on the first pair of lower belts and a second series of left paddles symmetrically mounted on the second pair of lower belts.

3. The sheet collating device according to claim 1, wherein the sheet collating device comprises the pair of upper belts and the pair of upper belts is partitioned in more than two upper belts.

4. The sheet collating device according to claim 1, wherein the sheet collating device comprises the first and second pairs of lower belts and one of the first and second pairs of lower belts form a collate bed for supporting the sheets during collation.

5. The sheet collating device according to claim 1, wherein, for changing the drive direction of the pair of upper drive belts, the left upper drive shaft comprises a one-way clutch for driving the left upper drive pulley in a counter clockwise direction, while the right upper drive shaft comprises a one-way clutch for driving the right upper drive pulley in a clockwise direction.

6. The sheet collating device according to claim 1, wherein the first lower drive shaft is configured to drive the first pair of lower belts in clockwise direction, causing the first series of right paddles to push the collated set of sheets towards a divert area and wherein the second lower drive shaft is configured to drive the second pair of lower belts in counter clockwise direction, causing the first series of left paddles to push the collated set towards a folding unit.

7. The sheet collating device according to claim 1, wherein a main drive shaft which can be driven in either clockwise or counter clockwise direction is connected to the left upper drive shaft through a left drive belt, and to the right upper drive shaft through a right drive belt.

8. The sheet collating device according to claim 1, wherein the first and second lower drive shafts are configured to be driven simultaneously for keeping a curvilinear distance between the left and right paddles unchanged.

9. The sheet collating device according to claim 1, wherein the upper transport path is defined by a cover plate crossed by a succession of free wheels in contact with the pair of upper belts and a support plate supporting the sheets during transport in the upper transport path.

10. The sheet collating device according to claim 9, wherein the cover plate is mounted on a first pivot allowing access to the upper transport path in case of jam.

11. The sheet collating device according to claim 10, wherein an upper transport assembly comprising at least the support plate, the pair of upper belts, the upper drive pulleys and the upper drive shafts is mounted on a second pivot allowing access to the collation area.

12. The sheet collating device according to claim 1, further comprising a collate bed having a convex shape facing upwards for supporting the sheets during collation and keeping the sheets in touch with the pair of upper belts.

13. The sheet collating device according to claim 12, further comprising a restrictor wheel mounted on a free arm and resting over the collate bed for damping a rebound of the sheets when hitting the paddles.

14. The sheet collating device according to claim 1, further including a plurality of sensors.

15. A folder inserter comprising a sheet collating device according to claim 1.

* * * * *